US009644422B2

(12) United States Patent
Marocco

(10) Patent No.: US 9,644,422 B2
(45) Date of Patent: May 9, 2017

(54) MULTI-USE WINDOW COVERING HEAD RAIL

(71) Applicant: Norbert Marocco, Toronto (CA)

(72) Inventor: Norbert Marocco, Toronto (CA)

( * ) Notice: Subject to any disclaimer, the term of this patent is extended or adjusted under 35 U.S.C. 154(b) by 0 days.

(21) Appl. No.: 14/999,354

(22) Filed: Apr. 28, 2016

(65) Prior Publication Data

US 2016/0326799 A1 Nov. 10, 2016

Related U.S. Application Data

(60) Provisional application No. 62/179,410, filed on May 7, 2015.

(51) Int. Cl.

| | |
|---|---|
| ***E06B 9/264*** | (2006.01) |
| ***E06B 9/42*** | (2006.01) |
| ***E06B 9/262*** | (2006.01) |
| ***E06B 9/323*** | (2006.01) |
| ***A47H 1/04*** | (2006.01) |
| ***A47H 13/04*** | (2006.01) |
| ***A47H 1/13*** | (2006.01) |
| ***E06B 9/36*** | (2006.01) |
| *E06B 9/24* | (2006.01) |

(52) U.S. Cl.

CPC ..... *E06B 9/42* (2013.01); *A47H 1/04* (2013.01); *A47H 1/13* (2013.01); *A47H 13/04* (2013.01); *E06B 9/262* (2013.01); *E06B 9/264* (2013.01); *E06B 9/323* (2013.01); *E06B 9/36* (2013.01); *E06B 2009/2452* (2013.01); *E06B 2009/2625* (2013.01)

(58) Field of Classification Search

CPC . E06B 9/42; E06B 9/264; E06B 9/323; E06B 2009/2452

USPC ..... 160/108, 89, 168.1 V, 345

See application file for complete search history.

(56) References Cited

U.S. PATENT DOCUMENTS

| | | | | |
|---|---|---|---|---|
| 4,023,235 | A * | 5/1977 | Cohen | A47H 1/04 16/94 D |
| 4,114,233 | A * | 9/1978 | Hamilton | A47H 1/04 16/95 R |
| 4,799,527 | A * | 1/1989 | Villoch | E06B 9/36 160/168.1 V |
| 4,840,216 | A * | 6/1989 | John | E06B 9/323 16/87.4 R |
| 4,846,249 | A * | 7/1989 | Cooper | A47H 15/02 16/102 |
| 5,205,334 | A * | 4/1993 | Judkins | B23Q 3/15526 160/108 |
| 6,712,115 | B2 * | 3/2004 | Judkins | E06B 9/264 160/178.1 R |
| 6,873,461 | B1 * | 3/2005 | McPherson, Jr. | E06B 9/50 160/23.1 |
| 6,941,996 | B2 * | 9/2005 | Ward | E06B 9/32 160/108 |
| 2012/0291963 | A1 * | 11/2012 | Marocco | E06B 9/262 160/120 |

* cited by examiner

*Primary Examiner* — David Purol

(57) ABSTRACT

A window covering head rail assembly having a top wall, front wall, and a bottom wall attached to the front wall, a pair of parallel opposed side walls extending downwardly from the bottom wall and defining an open space, a tubular channel-shaped window covering support secured between the side walls, within the space, a pair of window covering support rail formations formed along the channel for carrying the window covering.

15 Claims, 6 Drawing Sheets

MULTI-USE WINDOW COVERING HEAD RAIL

This application is based on U.S. Provisional application Ser. No. 62/179,410, filed May 7, 2015, title Multi-use window covering head rail, inventor Norbert Marocco, the priority of which is claimed.

FIELD OF THE INVENTION

The invention relates to a head rail for a window covering having a transverse channel member for supporting a window covering, and in which the head rail incorporates adaptors, for enabling the head rail to support various different types of window coverings.

BACKGROUND OF THE INVENTION

Various different types of window coverings are available, such as vertical slats, venetians, concertina, panels of various fabrics, russians, balloons and others. These window coverings almost universally incorporate a head rail of some kind which can be attached above or adjacent to a window or doorway or building opening. The window covering can then be either lowered down and raised, or can be drawn from one side across the window and back again.

These window coverings in the past have been designed around various different head rail structures specific to that type of window covering. For a manufacturer to provide a full range of window coverings, each one of which required a specially designed head rail, was a considerable investment. It also meant that the manufacturer would be obliged to carry an inventory of numerous different parts for numerous different head rails.

In addition to these considerations, in the marketing of window coverings, customers are often uncertain as to which type of particular window covering will suit their needs. For example, if a customer orders window coverings with vertical slats and then decides for example that they would prefer a pleated panel of material, then the supplier would be obliged to remove the window covering completely and replace it with a different one and a different head rail. This would also result in many cases, damage to the building structure around the opening. Even though such damage might be slight, such as for example the requirements for inserting different fastenings in different positions for different window coverings, the completion of the work would require at least the covering of the previous fastening openings in the building, before the new or replacement window covering could be attached.

Finally, in the event of a window covering becoming unserviceable or requiring some kind of repair, it will be preferable if instead of repairing an existing window covering, the portion which is unserviceable can simply be replaced, without the need for removing the entire head rail and replacing it with a new window covering.

For any of these reasons, it is desirable to provide a head rail which removably supports a separate window covering support, and which can be readily adapted to support a variety of different types of window coverings, with a minimum of adaptation. Preferably the head rail incorporates parts which are interchangeable.

BRIEF SUMMARY OF THE INVENTION

With a view to providing a window covering head rail which is adaptable to various different window coverings, the invention provides a head rail assembly having a top wall, and a front wall, and comprising; a bottom wall attached to said front wall; a pair of parallel opposed side walls extending downwardly from said bottom wall and defining an open space there between; a channel-shaped window covering support secured between said side walls, within said space and window covering support formations formed along said channel, for supporting a window covering therefrom.

The invention further provides such head rail wherein the channel-shaped support has window covering support moveable trolleys.

The invention further provides such a head rail wherein the window covering is a pleated panel, having a top support panel, wherein said top support panel is supported within said channel.

Preferably the invention provides a spacer member adapted to be fitted around said channel, and fitted snugly within said side walls of said bottom wall, thereby removably supporting the channel within the side walls of the bottom wall of the head rail.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
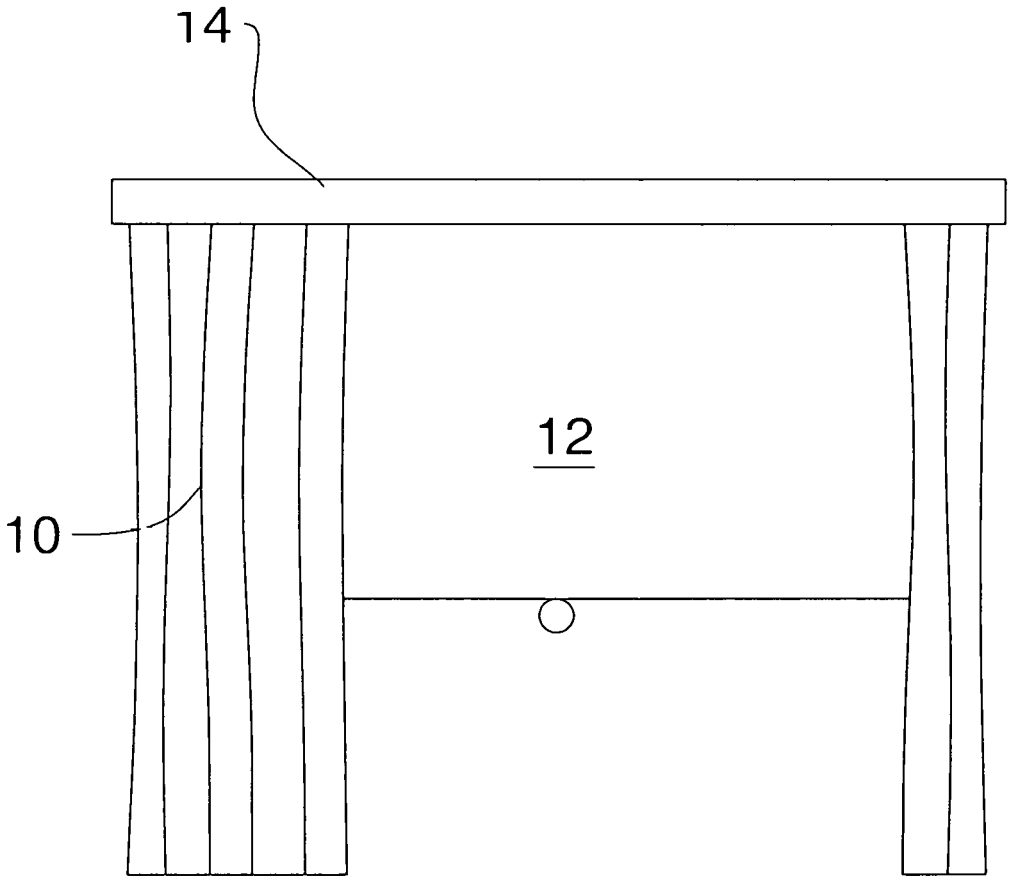
FIG. 1 is a front elevation of a form of window covering incorporating a fabric panel and a roll up black out blind.

Referring first of all to FIG. 1, it will be seen that the invention is there illustrated in the form of a window covering comprising a fabric panel (10), and a roll up black out blind (12). Both the panel and the roll up blind are incorporated and supported in a single head rail indicated as (14).

The head rail (14) is an enclosure having a top wall (16) and back wall (18) and a front wall (20). It will be seen that the front wall is of semi-arcuate shape in section, providing adequate space for the roll up blind and at the same time providing a pleasing aesthetic appearance.

The roll up blind is supported on suitable rotatable bearing devices (22), mounted in each end of the head rail.

The roll up blind may be a simple form of blind operated by an internal spring and a ratchet lock, such has been well known in the art for very many years.

Alternatively, it may be operated by an endless chain running around a toothed wheel (not shown) such as are well known in the art.

The invention does not exclude the possibility of providing for electrically powered operation if that is desired. The roll up blind will typically be a panel of opaque material which will exclude all outside light. The panel will stretch from one side of the window frame to the other, and be located as close as possible to the window, so as to prevent any light from becoming visible around the edges of the roll up blind.

The roll up blind will be located in an upper region of the head rail, and in fact substantially filling the area enclosed by the head rail.

This type of double window covering is intended to provide both substantially total light exclusion when that is required, for example for ensuring a good sleep, and on the other hand, the fabric panel (10) may provide for the entry of some exterior light while providing privacy for the persons within the building. In order to provide a privacy type blind, the window covering in this embodiment is provided by one or more sheer fabric panels (26). It will be appreciated that this is merely an example of the various types of privacy window coverings that can be provided as described above, and is shown here merely by way of example. For this purpose the sheer panels (26) are curtains, and are provided with wire z-shaped hooks (28), along their upper edge.

The hooks are connected to wheeled trolleys (30), by means of rings (32). Conventionally, such trolleys would for example be carried on an I-beam type of curtain rail. Such simple curtain rails do not add to the decor or theme of a room. In many cases a home owner will attempt to conceal the I-beam with some kind of a valance.

In the present case, however, the typical I-beam type of curtain rail is replaced, in this example by a generally tubular rectangular channel separate from the head rail and formed by walls (34). The tubular channel walls (34) are open along their lower sides, defining opposed in turned horizontal rail formations or ledges (36), Upstanding flanges (38) extend along the two ledges (36). The trolleys (30) run on the ledges (36) between the flanges (38).

In order to provide increased strength further reinforcement walls (40) are provided extending downwardly from the upper wall of the tubular channel (34).

Figure 2:
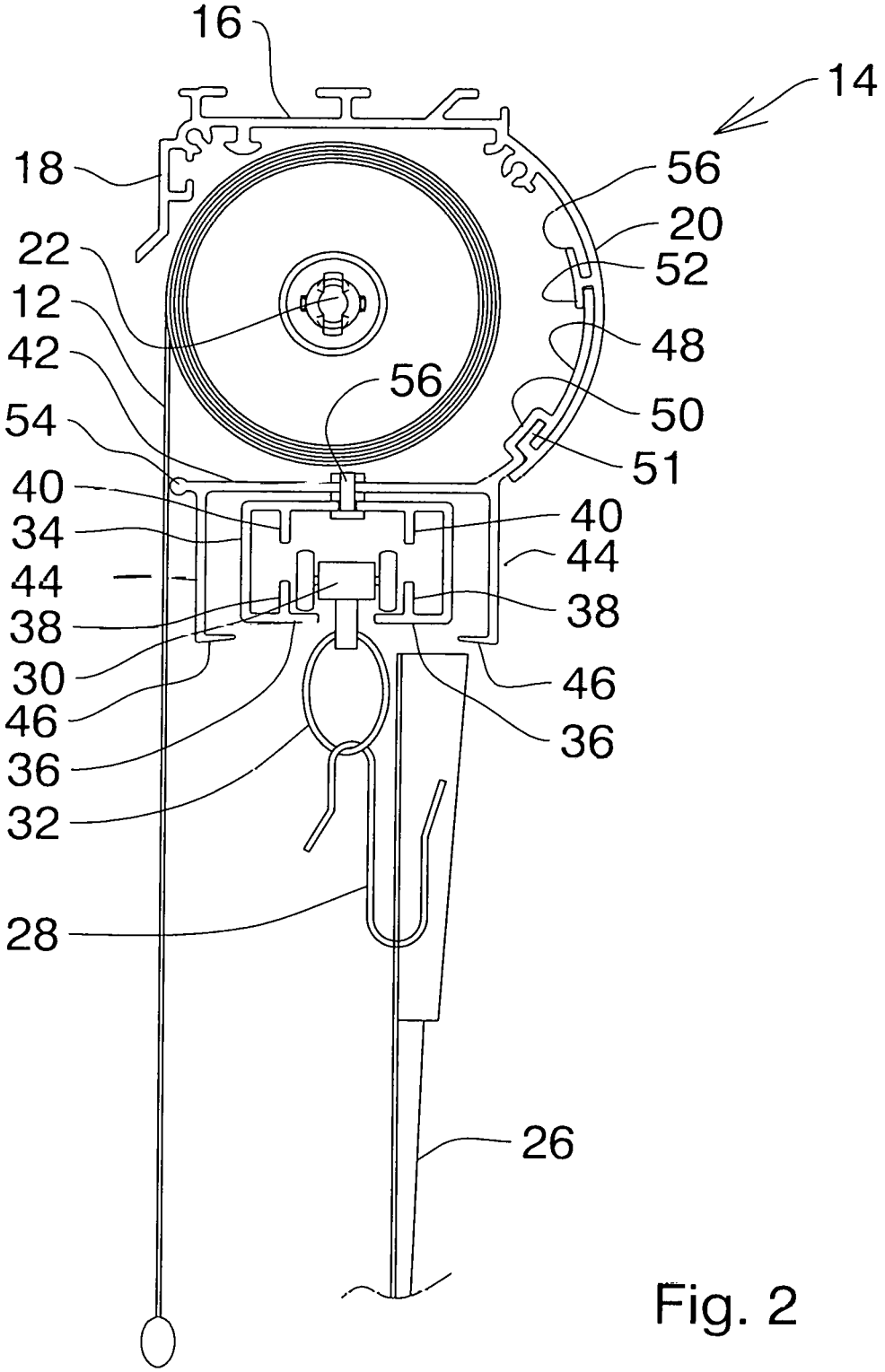
FIG. 2 is a section along the line 2-2 of FIG. 1.

It will be appreciated however, that the illustration in FIG. 2 of the tubular channel (34) is merely one of a variety of different types of support for window coverings which may be provided, and will be appropriate to different types of window coverings. Some window coverings will not require trolleys and will hang from the ledges. Other forms of window coverings, particularly for example vertical slats, may require a different form of tubular channel (FIG. 8), in order to accommodate the various controls and adjustments required for vertical slat window coverings, such as are well known in the art.

In order to accept and support the tubular channel (34), the head rail is provided with a bottom wall (42). Bottom wall (42) is formed with two lower parallel side walls (44), each of which ends in an in-turned lip (46), defining an open space there between.

The wall (42) along its forward edge is provided with an integral upward generally arcuate extension (48). Extension (48) is formed with a generally L-shaped slot (50), near its junction with the bottom wall (42) engaging a hook (51). At its upper end, the extension (48) fits within a slot (52), defined by a T-shaped member formed on the inner side of the front wall (20) of the head rail.

The rearward edge of bottom wall (42) is formed with an enlarged control rib (54). Control rib (54) is placed so as to hold the roller panel (12) rearwardly, clear of the curtains (26). The rib (54) also assists in keeping the roller panel (12) as close as possible to the window opening, thereby as far as possible preventing light from filtering around the side edges of the panel.

In this embodiment, the tubular channel (34) is secured to the bottom wall (42) by means of a series of fastenings (56). In this case the fastenings (56) are simply threaded bolts. However, fastenings of other types could be used. Preferably the fastenings are releasable.

It will be noted that there is a substantial clear space between the sides of the tubular channel (34), and the side walls (44) of the bottom wall (42). It will be seen therefore that the function of the two side walls (44) of the bottom wall (42) are mainly aesthetic in that they provide concealment for the actual mechanism of the head rail and additional strength. If desired, a valance bracket (58) could be attached as shown in phantom in FIG. 7, providing a uniform appearance, with a fabric strip attached to the valance bracket, which could complement the fabric of the curtains if desired.

Figure 3:
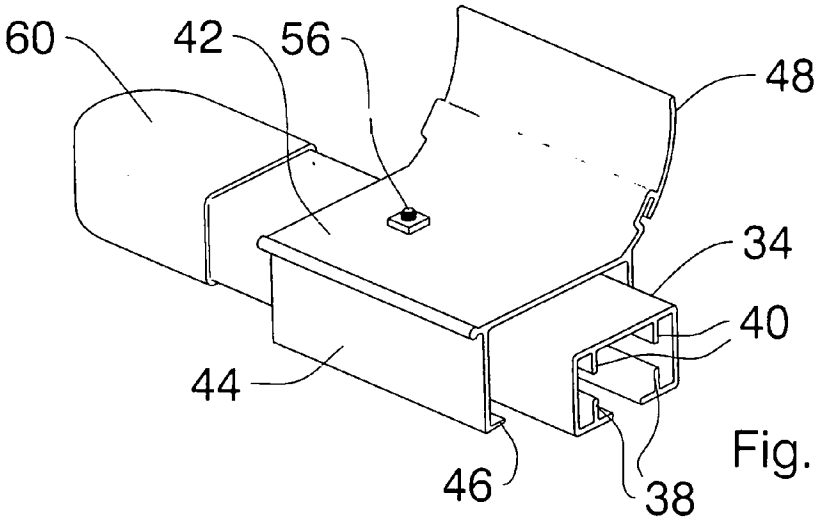
FIG. 3 is a perspective illustration of a portion of the head rail and transverse channel figure of the embodiment of the FIG. 2.
Figure 4:
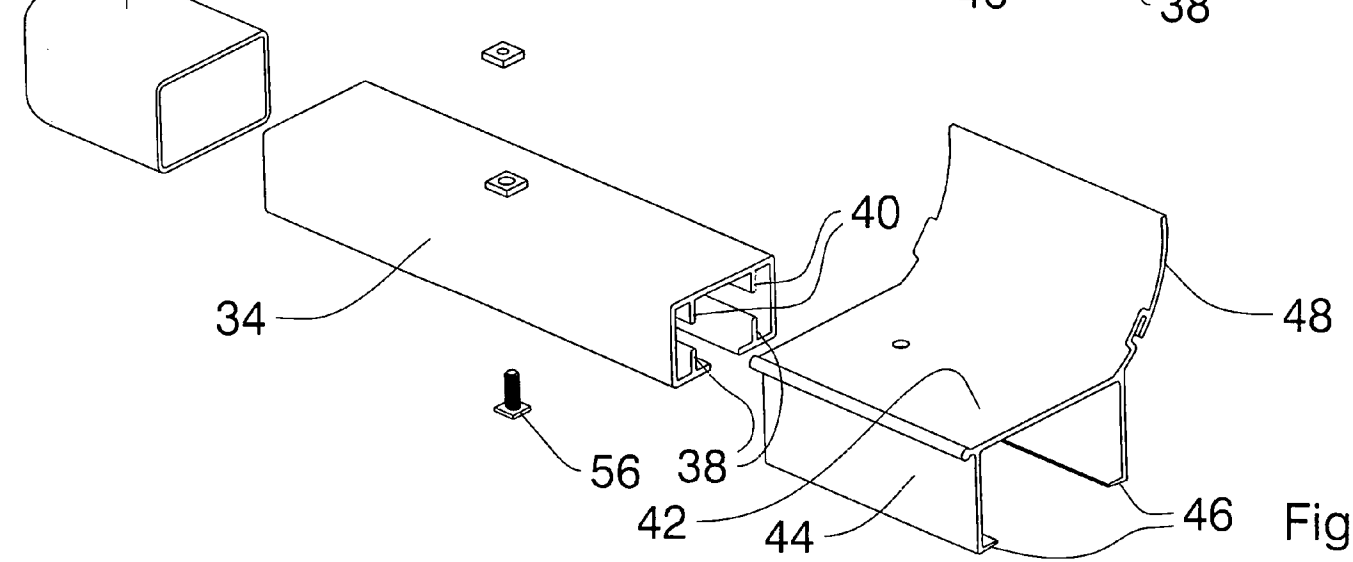
FIG. 4 is an exploded view of FIG. 3.

As shown in FIGS. 3 and 4, the tubular channel (34) can be closed at each end by a cap member (60), shaped to slide snugly onto the ends of the tubular channel (34) as shown and retain the trolleys.

Figure 5:
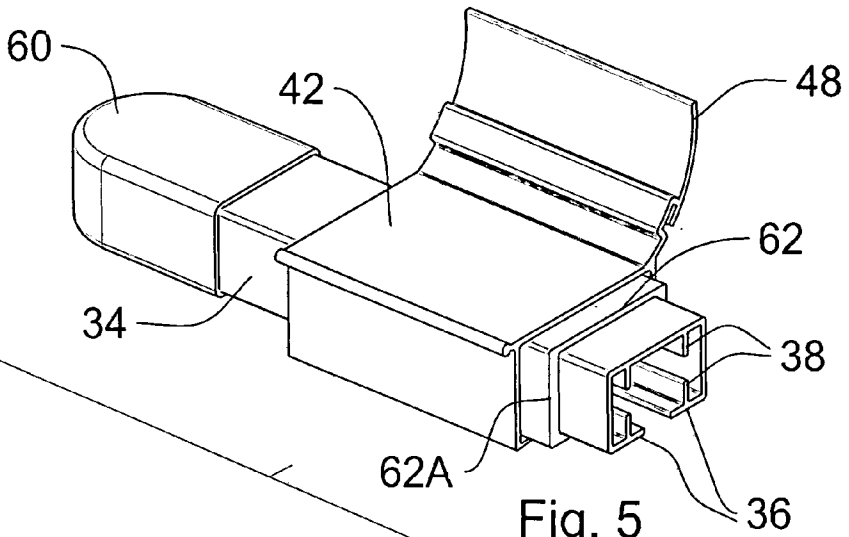
FIG. 5 is a cut away perspective illustration of an alternate embodiment.
Figure 6:
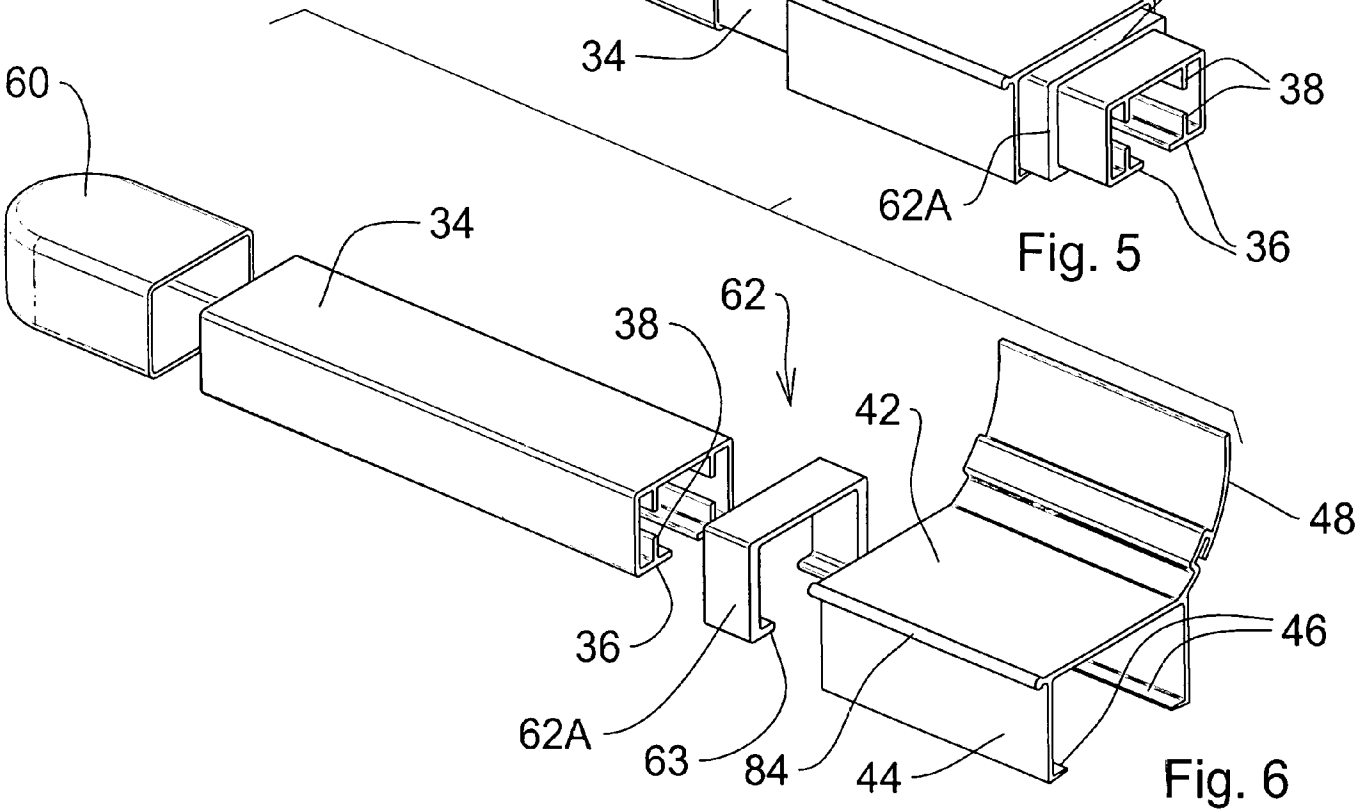
FIG. 6 is an exploded view of FIG. 5.

In accordance with another embodiment of the invention, as shown in FIGS. 5 and 6, the tubular channel (34) can be removably secured between the side walls (44) of the bottom wall (42) by, for example, spacer clips (62), having side walls (62 A) and in turned hooks (63). The spacer clips (62) would typically be of moulded thermo plastic, or could be extruded aluminum if desired. They would be sized to make a snug fit between the side walls (44) and lips (46) of bottom wall (42) and the tubular channel walls (34). Clips (62) can be slid along the tubular channel, and thus closely embrace the tubular channel walls (34) and ledges (36). Several of such clips (62) could be provided along the length of the tubular channel, to provided adequate support.

The tubular channel in this case will not require separate fastenings, and would be removable by simply sliding it out of one end of the head rail bottom wall.

By means of the invention it will be seen that tubular channel (34) supporting various different types of window coverings can be employed, within a standard head rail having a bottom wall (42) and side walls (44). Various different covering supports can be employed in this way, and it will be substantially invisible to persons in the building. Replacement or exchange of a window covering, can be achieved simply by removing the tubular channel (34) from the bottom wall (42) and side walls (44), and replacing it with another tubular channel and a different type of window covering.

Figure 7:
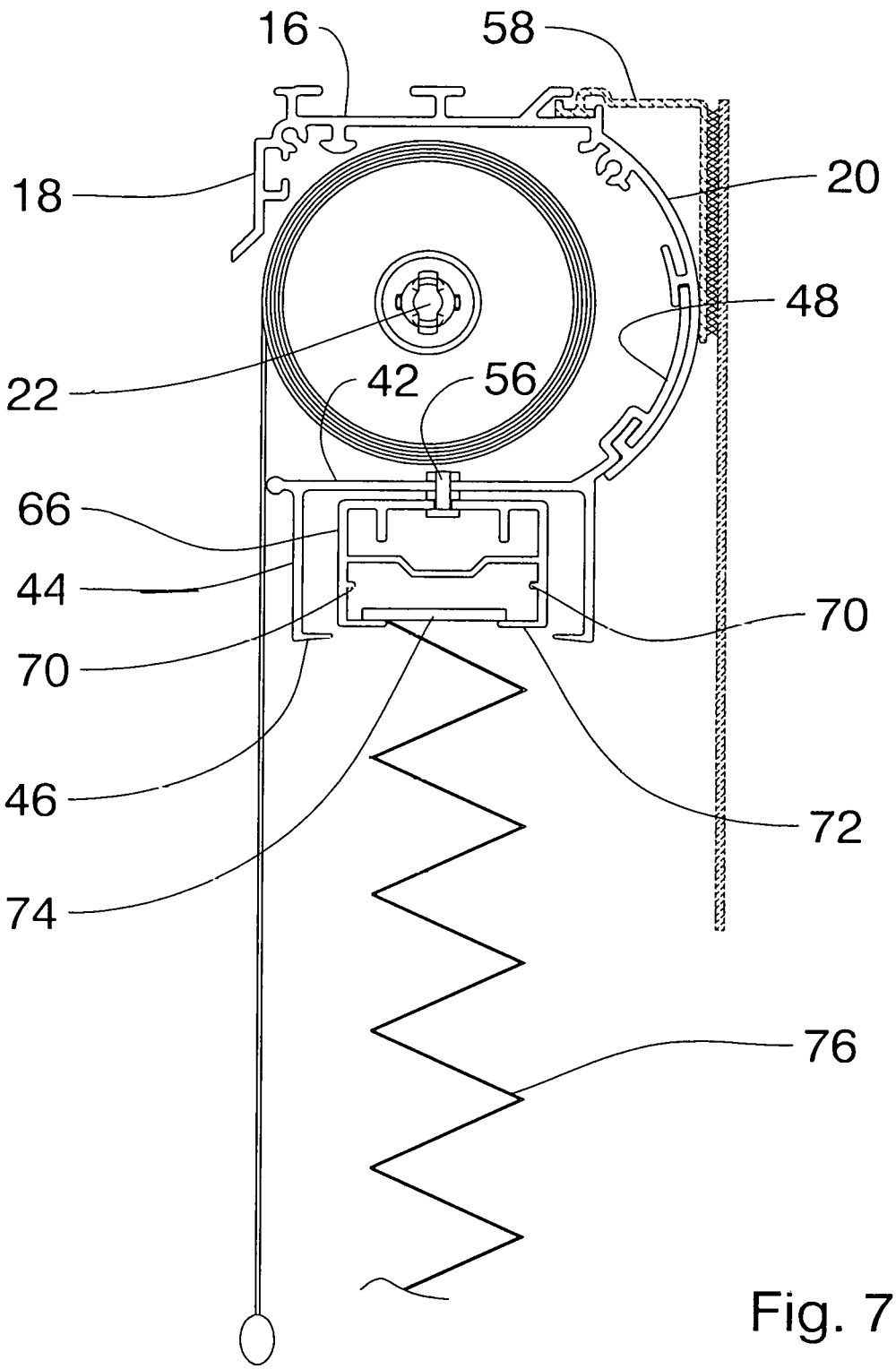
FIG. 7 is a section, corresponding to FIG. 2, showing a first alternate embodiment; and, FIG. 8 is a section corresponding to FIG. 2, showing a second alternate embodiment.

For example, a minor change in the head rail can be used to make the embodiment of FIG. 7. In this case, the bottom wall (42) and the side walls (44), together enclose a modified form of tubular support (66). In this case the tubular support comprises a top wall (68) and side walls (70), and in-turned rails or ledges (72). It may be retained within the bottom wall (42), by means such as suitable threaded fastenings or the like.

Within the tubular support (66) hanging from the rails (72) there is a top panel (74) of a typical pleated panel window covering (76). Covering (76) may be raised and lowered by means of suitable raise cords (not shown) such as are well known in the art. It will thus be seen that this embodiment can be made from essentially the same components as the basic head rail of FIGS. 1 to 5, with the only modification being the substitution of a different form of tubular channel and a different form of window covering panel.

Figure 8:
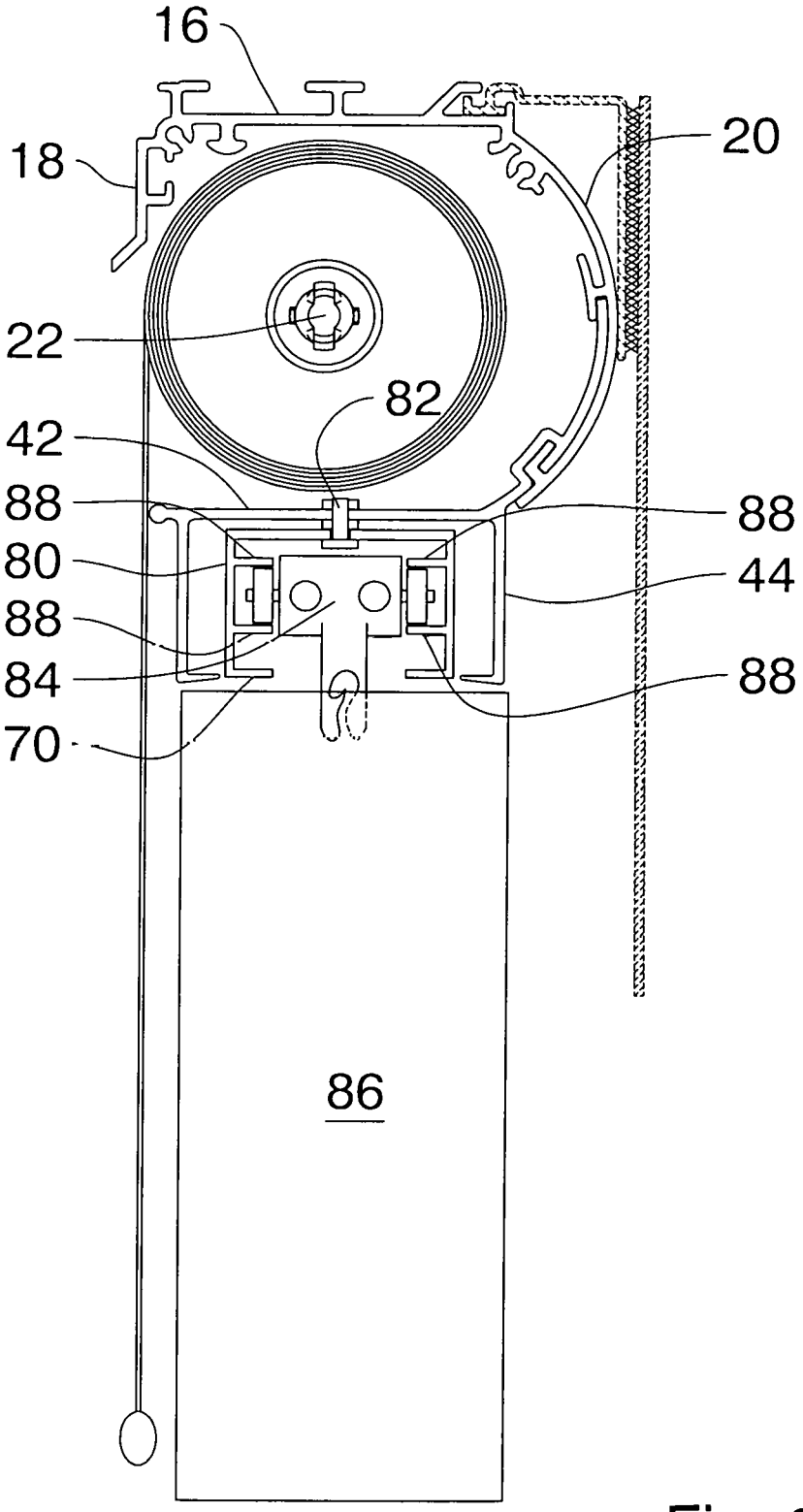

A still further embodiment is illustrated, simply by way of example only, in FIG. 8. In this case a tubular channel (80) is enclosed within the bottom wall (42) and side walls (44), and is retained therein by means of, for example, fastenings (82) or for example, the spacer clips of FIGS. 4 and 5 described above. In this case trolleys (84) carry vertical slate (86) in a known type of vertical window covering.

For this purpose tubular channel (80) has pairs of horizontal rails or ledges (88) extending from side walls of channel (80) inwardly, intermediate between the upper and lower edges of the side walls. The trolleys can run on the lower rails as shown.

From these examples it will be seen that the head rail and bottom wall and side walls can be adapted to assembling a variety of different window coverings, all being based on the roll up black out blind, incorporated together with a more pleasing form of window covering, to suit the wishes of the customer.

The head rail (10) and bottom wall (42) can be extruded as a single integral component, if desired. The valance bracket (58) can also be added integrally.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A window covering head rail assembly for replaceably supporting a window covering and having a head rail top wall, and a head rail front wall, and comprising;

a head rail bottom wall attached to said head rail front wall;

a pair of parallel opposed side walls extending downwardly from said head rail bottom wall and defining an open space there between;

lips on lower edges of said parallel opposed side walls, said lips being substantially horizontal and extending towards one another in a common plane and defining a restricted opening there between restricting viewing of said open space between said side walls;

a tubular channel-shaped window covering support separate from said head rail bottom wall and removably supported between said side walls of said head rail bottom wall, within said space there between;

a pair of window covering support rail formations formed along said tubular channel shaped window covering support for controlling a said window covering; and releasable fastenings securing said tubular channel shaped window covering support within said open space between said side walls of said head rail bottom wall, enabling removal and replacement of said tubular channel-shaped window covering support from within said head rail bottom wall.

2. The window covering head rail assembly for replaceably supporting a window covering as claimed in claim 1 including window covering moveable trolleys in said channel shaped window covering support.

3. The window covering head rail assembly for replaceably supporting a window covering as claimed in claim 1 wherein the window covering is a pleated panel, having a top fastening panel, wherein said top fastening panel is supported within said channel shaped window covering support.

4. The window covering head rail assembly for replaceably supporting a window covering as claimed in claim 1 including a spacer clip members dimensioned to be fitted around said channel shaped window covering support, and fitted snugly within said side walls of said head rail bottom wall, and being releasable to enable replacement of said channel shaped member.

5. The window covering head rail assembly for replaceably supporting a window covering as claimed in claim 1 including releasable threaded bolt fastenings securing said channel shaped window covering support to said head rail bottom wall and being releasable to enable replacement of said channel shaped member.

6. The window covering head rail assembly for replaceably supporting a window covering as claimed in claim 1 including cap members on each end of said channel shaped window covering support.

7. The window covering head rail assembly for replaceably supporting a window covering as claimed in claim 1 where said head rail front wall is of curved profile, and including a connector wall on said head rail bottom wall attaching to said head rail front wall.

8. The window covering head rail assembly for replaceably supporting a window covering as claimed in claim 1 including a roller blind located above said head rail bottom wall, and operable to depend downwardly therefrom and including a control rib on said head rail bottom wall controlling said roller blind.

9. The window covering head rail assembly for replaceably supporting a window covering as claimed in claim 1 wherein said channel shaped covering support defines parallel vertical side walls and wherein said rail formations lie in a generally horizontal plane extending from said channel shaped window covering support side walls inwardly towards each other.

10. The window covering head rail assembly for replaceably supporting a window covering as claimed in claim 9 wherein said rail formations extend from lower edges of respective channel vertical side walls.

11. The window covering head rail assembly for replaceably supporting a window covering as claimed in claim 9 wherein there are two pairs of said rail formations, and wherein said rail formations extend from said channel vertical side walls intermediate between upper and lower edges of said channel vertical side walls.

12. The window covering head rail assembly for replaceably supporting a window covering as claimed in claim 11 including wheeled trolleys located between said pairs of rail formations.

13. The window covering head rail assembly for replaceably supporting a window covering as claimed in claim 9 including vertical rail formations lying in vertical planes spaced apart from one another, and extending upwardly from said horizontal rail formations.

14. The window covering head rail assembly for replaceably supporting a window covering as claimed in claim 13 wherein there are two pairs of said vertical rail formations, a first pair of said vertical rail formations extending down within said channel shaped support, and a second pair of said vertical rail formations extending up from said horizontal rail formations within said channel shaped support.

15. The window covering head rail assembly for replaceably supporting a window covering as claimed in claim 14 and including wheeled trolleys located between said second pair of vertical rail formations, and supported on said horizontal rail formations.

* * * * *